US012104790B2

(12) United States Patent
Izumi et al.

(10) Patent No.: US 12,104,790 B2
(45) Date of Patent: Oct. 1, 2024

(54) AMMONIA COMBUSTION METHOD AND AMMONIA COMBUSTION SYSTEM

(71) Applicant: SAVE THE PLANET CO., LTD., Osaka (JP)

(72) Inventors: Mitsuhiro Izumi, Osaka (JP); Tsutomu Kusuhara, Osaka (JP)

(73) Assignee: SAVE THE PLANET CO., LTD., Osaka (JP)

( * ) Notice: Subject to any disclaimer, the term of this patent is extended or adjusted under 35 U.S.C. 154(b) by 472 days.

(21) Appl. No.: 17/629,608

(22) PCT Filed: Jan. 10, 2020

(86) PCT No.: PCT/JP2020/000607
§ 371 (c)(1),
(2) Date: Jan. 24, 2022

(87) PCT Pub. No.: WO2021/024511
PCT Pub. Date: Feb. 11, 2021

(65) Prior Publication Data

US 2022/0243914 A1 Aug. 4, 2022

(30) Foreign Application Priority Data

Aug. 6, 2019 (JP) ..... 2019-144610

(51) Int. Cl.
*F23N 5/02* (2006.01)
*F23K 5/00* (2006.01)

(52) U.S. Cl.
CPC ..... *F23N 5/02* (2013.01); *F23K 5/00* (2013.01); *F23N 2239/04* (2020.01)

(58) Field of Classification Search
None
See application file for complete search history.

(56) References Cited

U.S. PATENT DOCUMENTS

2012/0047870 A1* 3/2012 Kasuga ..... F02C 3/28 60/39.462

FOREIGN PATENT DOCUMENTS

| | | | |
|---|---|---|---|
| JP | H05-332152 | A | 12/1993 |
| JP | 2001-073796 | A | 3/2001 |
| JP | 2009-097421 | A | 5/2009 |
| WO | 2018/092478 | A1 | 5/2018 |

OTHER PUBLICATIONS

International Search Report of PCT/JP2020/000607, dated Feb. 10, 2020.

* cited by examiner

*Primary Examiner* — Ko-Wei Lin
(74) *Attorney, Agent, or Firm* — Quantum Patent Law Firm; Seongyoune Kang

(57) ABSTRACT

An ammonia combustion method for combusting ammonia gas in a combustion chamber 4 includes steps of separating and producing hydrogen gas from ammonia gas, supplying the separated and produced hydrogen gas into the combustion chamber 4, combusting the hydrogen gas by performing an ignition discharge on the hydrogen gas supplied into the combustion chamber 4, and igniting the ammonia gas in the combustion chamber 4 from the combusted hydrogen gas.

11 Claims, 5 Drawing Sheets

2A

AMMONIA COMBUSTION METHOD AND AMMONIA COMBUSTION SYSTEM

CROSS-REFERENCE TO RELATED APPLICATIONS

This patent application is a U.S. national stage application of International Application No. PCT/JP2020/000607, filed Jan. 10, 2020 and the entire contents of which are incorporated herein by reference, which claims priority to Japanese Application No. 2019-144610, filed Aug. 6, 2019 and the entire contents of which are incorporated herein by reference.

TECHNICAL FIELD

The present invention relates to a flame-retardant ammonia combustion method and an ammonia combustion system.

BACKGROUND ART

In recent years, with a demand for reducing carbon dioxide emissions, expectations for ammonia gas, which does not emit carbon dioxide even in combustion, are increasing as a replacement fuel for carbon-based fuel. Meanwhile, ammonia is a flame-retardant fuel, and compared to carbon-based fuel, it is difficult to ignite (start ignition) and has a slower combustion rate. Specifically, the energy required to ignite a carbon-based fuel is about 80 to 120 mJ, whereas the energy required to ignite ammonia gas is about 400 to 600 mJ. Also, the laminar combustion rate of ammonia gas is about 7 times slower than that of carbon-based fuel (for example, general hydrocarbon-based fuels such as methane gas or propane gas).

In combustion systems that use flame-retardant ammonia gas as a fuel, unburned ammonia gas or nitrogen oxides are produced due to the incomplete combustion of the fuel. Therefore, various techniques for effectively combusting the ammonia gas have been proposed (for example, Patent Document 1).

CITATION LIST

Patent Documents

Patent Document 1: Japanese Unexamined Patent Application Publication No. 2010-159705

SUMMARY OF INVENTION

Problems to be Solved by Invention

However, when a flame-retardant fuel such as ammonia gas is combusted, initial ignition of the ammonia gas is difficult when compared to a case where carbon-based fuel, which is currently widely used, is combusted. In addition, it is difficult to continue to stably combust the ammonia gas even after ignition.

An object of the present invention is to provide an ammonia combustion method capable of effectively initially igniting ammonia gas and continuing to stably combust the ammonia gas even after ignition to address the problems described above.

Means for Solving the Problems

According to the present invention, there is provided an ammonia combustion method for combusting ammonia gas in a combustion chamber, including steps of: separating and producing hydrogen gas from ammonia gas; supplying the separated and produced hydrogen gas into the combustion chamber; combusting the hydrogen gas by performing an ignition discharge on the hydrogen gas supplied into the combustion chamber; and igniting the ammonia gas in the combustion chamber from the combusted hydrogen gas.

In the combustion method according to the invention, first the hydrogen gas is combusted to warm the combustion chamber to a certain degree, then the flame-retardant ammonia gas is supplied so that the flame is transferred from the combusted hydrogen gas to the supplied ammonia gas. Consequently, the highly combustible hydrogen gas is combusted first, and the ammonia gas is ignited from the combusted hydrogen gas, therefore it is possible to effectively initially ignite the ammonia gas and continue to stably combust the ammonia gas even after ignition.

The combustion method according to an embodiment further includes a step of supplying the ammonia gas into the combustion chamber.

In the combustion method according to the invention, combustion energy can easily be changed by adjusting the amount of the ammonia gas supplied into the combustion chamber. Therefore, it is possible to easily adjust the energy required for various types of combustion, such as automobile or motorcycle engines, high heat furnaces, and biomass, etc.

In the combustion method according to an embodiment, the ammonia gas is supplied into the combustion chamber when a temperature in the combustion chamber reaches a predetermined temperature.

In the combustion method according to the invention, warming is performed until the temperature in the combustion chamber reaches a predetermined temperature. Therefore, it is possible to more effectively initially ignite the ammonia gas.

The combustion method according to an embodiment further includes steps of: detecting combustion state information indicating a combustion state of the ammonia gas; and adjusting an amount of the hydrogen gas supplied into the combustion chamber on the basis of the detected combustion state information.

In the combustion method according to the invention, the amount of the hydrogen gas supplied can be promptly adjusted in accordance with the combustion state of the ammonia gas. Therefore, it is possible to continue to stably combust the ammonia gas more effectively.

In the combustion method according to an embodiment, the combustion state information is information regarding an ion current based on ions generated by combusting the ammonia gas, or a turbine output using energy caused by combusting the ammonia gas.

In the combustion method according to the invention, the combustion state of the ammonia gas is identified based on the ion current caused by ions generated by combusting the ammonia gas, or the turbine output using energy caused by combusting the ammonia gas. Consequently, it is possible to identify the combustion state of the ammonia gas more reliably, therefore it is possible further suppress wasteful consumption of the hydrogen gas.

In the combustion method according to an embodiment, in the step of separating and producing the hydrogen gas from the ammonia gas, the hydrogen gas is separated and produced by reforming the ammonia gas through a dielectric barrier discharge.

In the combustion method according to the invention, a separate hydrogen gas is not necessary. Therefore, it is possible to reduce cost.

In another aspect, there is provided an ammonia combustion method for combusting ammonia gas in a combustion chamber, including steps of: separating and producing hydrogen gas from ammonia gas; supplying the separated and produced hydrogen gas into the combustion chamber; combusting the hydrogen gas by performing an ignition discharge on the hydrogen gas supplied into the combustion chamber; supplying a mixed gas obtained by mixing the separated and produced hydrogen gas and the ammonia gas into the combustion chamber; and igniting the supplied mixed gas from the combusted hydrogen gas.

In the combustion method according to the invention, first the hydrogen gas is combusted to warm the combustion chamber to a certain degree, then the flame is transferred first to the mixed gas obtained by mixing the flame-retardant ammonia gas and the highly combustible hydrogen gas. Therefore, it is possible to transfer the flame more effectively than a case where the flame is transferred only to the ammonia gas.

The combustion method according to an embodiment further includes a step of reducing a proportion of the hydrogen gas in the mixed gas after igniting the mixed gas.

In the combustion method according to the invention, it is possible to set the combustion state of the ammonia gas to a more stable combustion state when compared to transferring the flame only to the highly flame-retardant ammonia gas. Therefore, it is possible to continue to more stably combust the ammonia gas.

In another aspect, there is provided a combustion system for combusting injected ammonia gas in a combustion chamber, including: a first pipe that supplies the ammonia gas into the combustion chamber; a first valve individually provided in the first pipe; a reformer that separates and produces hydrogen gas from the ammonia gas; a second pipe that supplies the separated and produced hydrogen gas into the combustion chamber; a second valve individually provided in the second pipe; an ignition plug that performs an ignition discharge on the hydrogen gas supplied into the combustion chamber to combust the hydrogen gas; and control means that controls opening and closing of the first and second valves and the ignition discharge of the ignition plug.

In the combustion system according to the invention, the control means for controlling the ignition operation of the ignition plug controls the opening and closing of the valves for supplying the hydrogen gas and the ammonia gas into the combustion chamber. Consequently, in the technology for combusting the ammonia gas effectively, a separate control device for opening and closing the valves is not necessary, therefore it is possible to suppress an increase in manufacturing costs.

In the combustion system according to an embodiment, the control means performs control such that first, the second valve is opened, the hydrogen gas is combusted by starting the ignition discharge, and the first valve is opened after the combustion of the hydrogen gas.

In the combustion system according to the invention, first the hydrogen gas is combusted to warm the combustion chamber to a certain degree, then the flame-retardant ammonia gas is supplied so that the flame is transferred from the combusted hydrogen gas to the supplied ammonia gas. Consequently, the highly combustible hydrogen gas is combusted first, and the ammonia gas is ignited from the combusted hydrogen gas, therefore it is possible to effectively initially ignite the ammonia gas and continue to stably combust the ammonia gas even after ignition.

The combustion system according to an embodiment further includes a temperature sensor that detects a temperature in the combustion chamber, and the control means increases the temperature in the combustion chamber to a predetermined temperature on the basis of the temperature in the combustion chamber detected by the temperature sensor.

In the combustion system according to the invention, first the hydrogen gas is combusted to warm the combustion chamber to a certain degree, then the flame is transferred first to the mixed gas obtained by mixing the flame-retardant ammonia gas and the highly combustible hydrogen gas. Therefore, it is possible to transfer the flame more effectively than a case where the flame is transferred only to the ammonia gas.

The combustion system according to an embodiment further includes combustion state detection means that detects combustion state information indicating a combustion state of the ammonia gas in the combustion chamber, and the control means performs control so as to adjust an amount of the hydrogen gas supplied into the combustion chamber on the basis of the combustion state information detected by the combustion state detection means.

In the combustion system according to the invention, it is possible to promptly adjust the amount of the hydrogen gas supplied in accordance with the combustion state of the ammonia gas. Therefore, it is possible to continue to stably combust the ammonia gas more effectively.

In the combustion system according to an embodiment, the combustion state information is information regarding an ion current based on ions generated by combusting the ammonia gas, or a turbine output using energy caused by combusting the ammonia gas.

In the combustion system according to the invention, the combustion state of the ammonia gas is identified based on the ion current caused by ions generated by combusting the ammonia gas, or the turbine output using energy caused by combusting the ammonia gas. Consequently, it is possible to identify the combustion state of the ammonia gas more reliably, therefore it is possible to further suppress wasteful consumption of the hydrogen gas.

In the combustion system according to an embodiment, the control means reforms the ammonia gas to separate and produce the hydrogen gas by controlling the dielectric barrier discharge in the reformer.

In the combustion system according to the invention, the control means for controlling the ignition operation of the ignition plug is capable of controlling the dielectric barrier discharge for producing a second fuel more combustible than a first fuel by reforming the first fuel. Consequently, in the technology for combusting the ammonia gas effectively as described above, a separate control device for generating the dielectric barrier discharge for producing the necessary hydrogen gas is not necessary, therefore it is possible to suppress an increase in manufacturing costs.

Advantageous Effects

In the combustion method according to the present invention, first the hydrogen gas is combusted to warm the combustion chamber to a certain degree, then the flame-retardant ammonia gas is supplied so that the flame is transferred from the combusted hydrogen gas to the supplied ammonia gas. Therefore, it is possible to effectively initially ignite the ammonia gas and continue to stably combust the ammonia gas even after ignition.

DESCRIPTION OF EMBODIMENTS

Hereinafter, the embodiments according to the present invention will be described with reference to the drawings.

Embodiment 1

Figure 1:
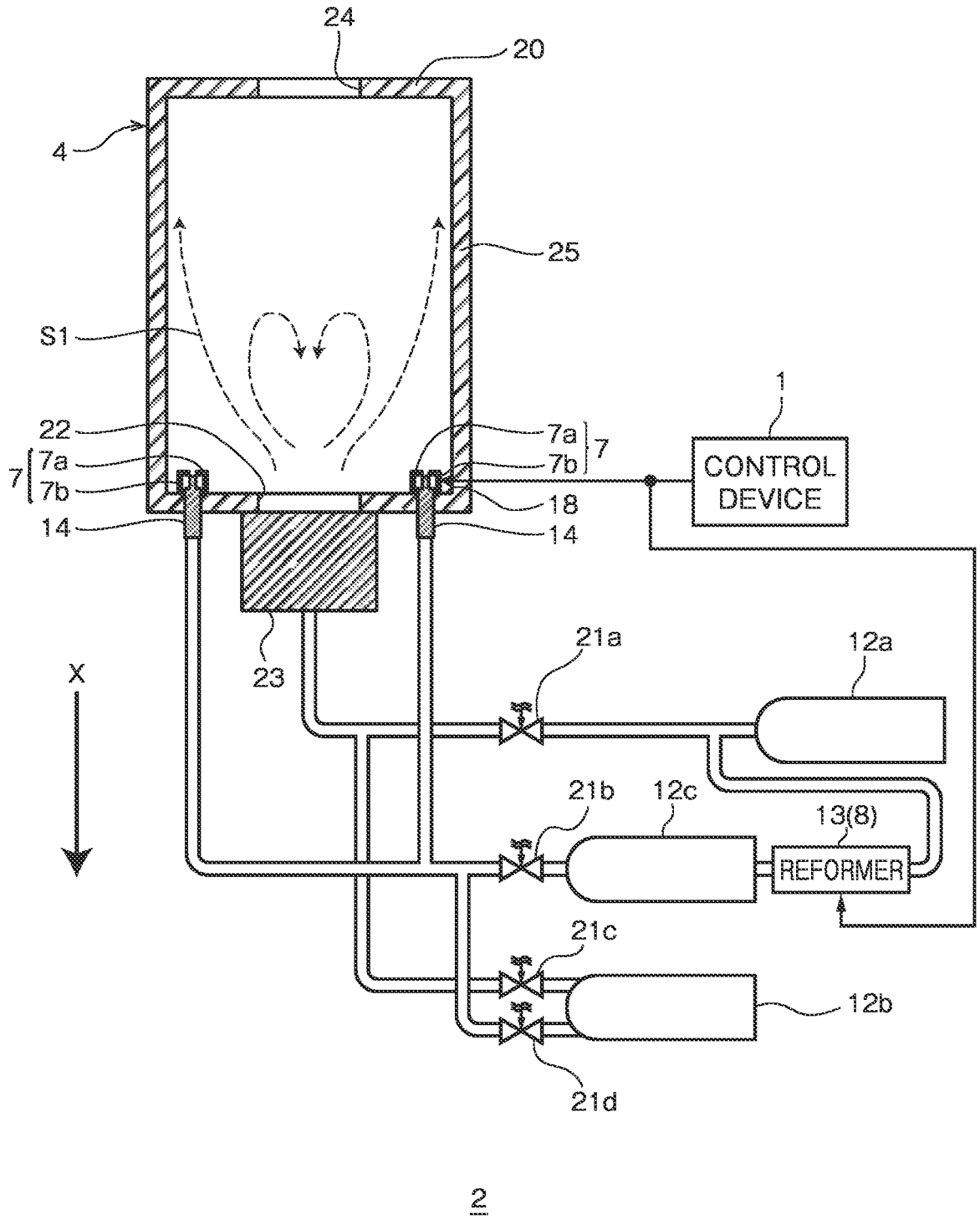
FIG. 1 is a partially cutaway side view illustrating a combustion system 2 according to Embodiment 1 of the present invention and a block diagram illustrating its peripheral components.

FIG. 1 is a partially cutaway side view illustrating a combustion system 2 according to an embodiment of the present invention and a block diagram illustrating its peripheral components. The combustion system 2 of FIG. 1 is configured of tubular heat-resistant glass or stainless steel, and includes a combustion chamber 4 that internally combusts an injected fuel, a circular inlet port 22 for feeding the fuel into the combustion chamber 4, a swirler (swirl vane) 23 located at the inlet port 22 and provided in the combustion chamber 4, a fuel tank 12*a* that stores highly flame-retardant ammonia gas (first fuel), a reformer 13 as a hydrogen generator that reforms the ammonia gas through a dielectric barrier discharge to produce hydrogen gas (second fuel) that is more combustible than the ammonia gas, and supplies the hydrogen gas into the combustion chamber 4, a fuel tank 12*c* that stores the hydrogen gas produced by the reformer 13, an air compressor 12*b* that supplies air as an oxidant, valves 21*a* to 21*d* that adjust the respective amounts supplied of the ammonia gas, the hydrogen gas, and the air, a pilot burner 14 supported by a bottom portion 18 of the combustion chamber 4, an ignition plug 7 that ignites the pilot burner 14 in the vicinity of the pilot burner 14, and a control device 1 as control means for controlling both an ignition operation of the ignition plug 7 and the dielectric barrier discharge of the reformer 13, as well as opening and closing of the valves 21*a* to 21*d*.

The combustion system 2 described above is configured as a combustion system that combusts the injected ammonia gas in the combustion chamber 4, and includes a first pipe that supplies the ammonia gas into the combustion chamber 4, a valve 21*a* provided in the first pipe, a reformer 13 that separates and produces the hydrogen gas from the ammonia gas, a second pipe that supplies the separated and produced hydrogen gas into the combustion chamber 4, a valve 21*b* provided in the second pipe, an ignition plug 7 that performs an ignition discharge on the hydrogen gas supplied into the combustion chamber 4 to combust the hydrogen gas, and a control device 1 that controls the opening and closing of the valves 21*a* and 21*b* and the ignition discharge of the ignition plug 7. Here, the valve 21*a* is provided separately from the first pipe and the valve 21*b* is provided separately from the second pipe.

The ignition plug 7 of FIG. 1 has a discharge electrode 7*a* with a hook-shaped tip and a ground electrode 7*b* with a hook-shaped tip, and the discharge electrode 7*a* and the ground electrode 7*b* are each formed so as to protrude inside the combustion chamber 4 from the bottom portion 18. Note that a high voltage is applied to the discharge electrode 7*a* from the control device 1, and as a result, a spark is generated between the tip of the discharge electrode 7*a* and the tip of the ground electrode 7*b* to ignite the hydrogen gas ejected from the pilot burner 14.

In addition, the combustion system 2 of FIG. 1 includes combustion state detection means (not shown) in the combustion chamber 4 that detects combustion state information indicating a combustion state of the ammonia gas in the combustion chamber 4. Here, the control device 1 is configured to stop supply of the hydrogen gas into the combustion chamber 4 when it is determined that the ammonia gas has reached the optimal combustion state based on the combustion state information detected by the combustion state detection means.

For example, the combustion state detection means described above may be an ion current detection unit (not shown) that detects an ion current generated by combusting the ammonia gas. Here, the control device 1 calculates an ion current value by controlling the ion current detection unit to detect the ion current, and controls the opening and closing of the valves 21*a* to 21*d* based on the calculated ion current value. The ion current detection unit includes an application electrode and a ground electrode, and it generates the ion current by attracting ions generated by combustion that are present around the application electrode to the application electrode. That is, as more ions are generated by combustion, a larger ion current will flow. Note that the ion current value is calculated by detecting the voltage in proportion to the ion current, and the combustion state of the ammonia gas, which is difficult to see, is identified based on the calculated ion current value, so that the combustion state can be controlled so as to continue to stably combust the ammonia gas.

Note that the combustion method of the combustion system 2 includes a step of measuring a correlation between a parameter representing the combustion state of the ammonia gas and the ion current to set a reference range of the ion current, and in the step of continuously combusting the ammonia gas, the optimal combustion state can be maintained by keeping the ion current detected by the ion current detection unit within this reference range.

In addition, the combustion state detection means described above may be configured to detect output information such as a number of rotations of a turbine using energy caused by the combustion of the ammonia gas. In this case, the control device 1 is configured to stop the supply of the hydrogen gas into the combustion chamber 4 when it is determined that the ammonia gas has reached the optimal combustion state based on the turbine output information as the combustion state information detected by the combustion state detection means.

Further, the combustion system 2 of FIG. 1 includes a temperature sensor (not shown) that measures a radiation temperature of the flame in the combustion chamber 4. Here, the temperature sensor is configured to be located externally to a flame surface of the flame in the combustion chamber 4 so that temperature data measured by the temperature sensor is transmitted to the control device 1, with the control device 1 controlling the opening and closing of the valves 21*a* to 21*d* based on the temperature data.

The combustion chamber 4 of FIG. 1 is configured to include a trunk portion 25 formed of tubular heat-resistant glass or stainless steel and elongated in a gravity direction X, a lid portion 20 that covers an upper opening of the trunk portion 25, and a bottom portion 18 that covers a lower opening of the trunk portion 25. At the center (core portion) of the bottom portion 18 of FIG. 1 is provided a circular inlet port 22 for feeding the flame-retardant ammonia gas into the combustion chamber 4. In addition, an outlet port 24 from which the flame is ejected is provided at the center of the lid portion 20 of FIG. 1.

The swirler 23 is supported by the bottom portion 18 of the combustion chamber 4 in the vicinity of the center of a horizontally cutaway cross-section of the combustion chamber 4. The ammonia gas is fed into the combustion chamber 4 as a swirling airflow S1 via the swirler 23. Here, ammonia gas of a predetermined concentration can be fed into the combustion chamber 4 as the swirling airflow S1 by adjusting the valve 21 connected to the fuel tank 12*a* and the valve 21 connected to the air compressor 12*b*. Note that the swirling airflow S1 flowing from the inlet port 22 travels upward while swirling and spreading along an inner wall (inner peripheral surface) of the combustion chamber 4. The ammonia gas in the central part of the combustion chamber 4 is attracted by this flow, and in the central part of the combustion chamber 4, the ammonia gas flows from the bottom to the top while forming a spiral shape.

In addition, a plurality of pilot burners 14 are arranged in an external region of the swirler 23. Specifically, the plurality of pilot burners 14 are arranged concentrically with respect to the swirler 23 in the vicinity of the inner wall of the combustion chamber 4 at equal pitches in the circumferential direction so as to surround the peripheral edge of the inlet port 22 (peripheral edge of the swirler 23) to eject the hydrogen gas, which is more combustible than the ammonia gas. Here, hydrogen gas of a predetermined concentration can be fed to each pilot burner 14 by adjusting the valve 21*b* connected to the reformer 13 and the valve 21*d* connected to the air compressor 12*b*.

The reformer 13 of FIG. 1 is configured to include a dielectric material that defines an ammonia gas flow path, a high voltage electrode arranged adjacent to the dielectric material, a hydrogen separation film grounded to function as a ground electrode while facing the high voltage electrode with the dielectric material being interposed therebetween, a hydrogen flow path that guides the hydrogen separated by the hydrogen separation film, and a high voltage power supply that generates a dielectric barrier discharge between the hydrogen separation film and the high voltage electrode by applying a bipolar pulse waveform to the high voltage electrode. Here, due to the discharge action between the hydrogen separation film and the high voltage electrode, it is possible to separate and produce a high yield of hydrogen gas from the ammonia gas. That is, the reformer 13 of FIG. 1 is a plasma type hydrogen generator.

Figure 2:
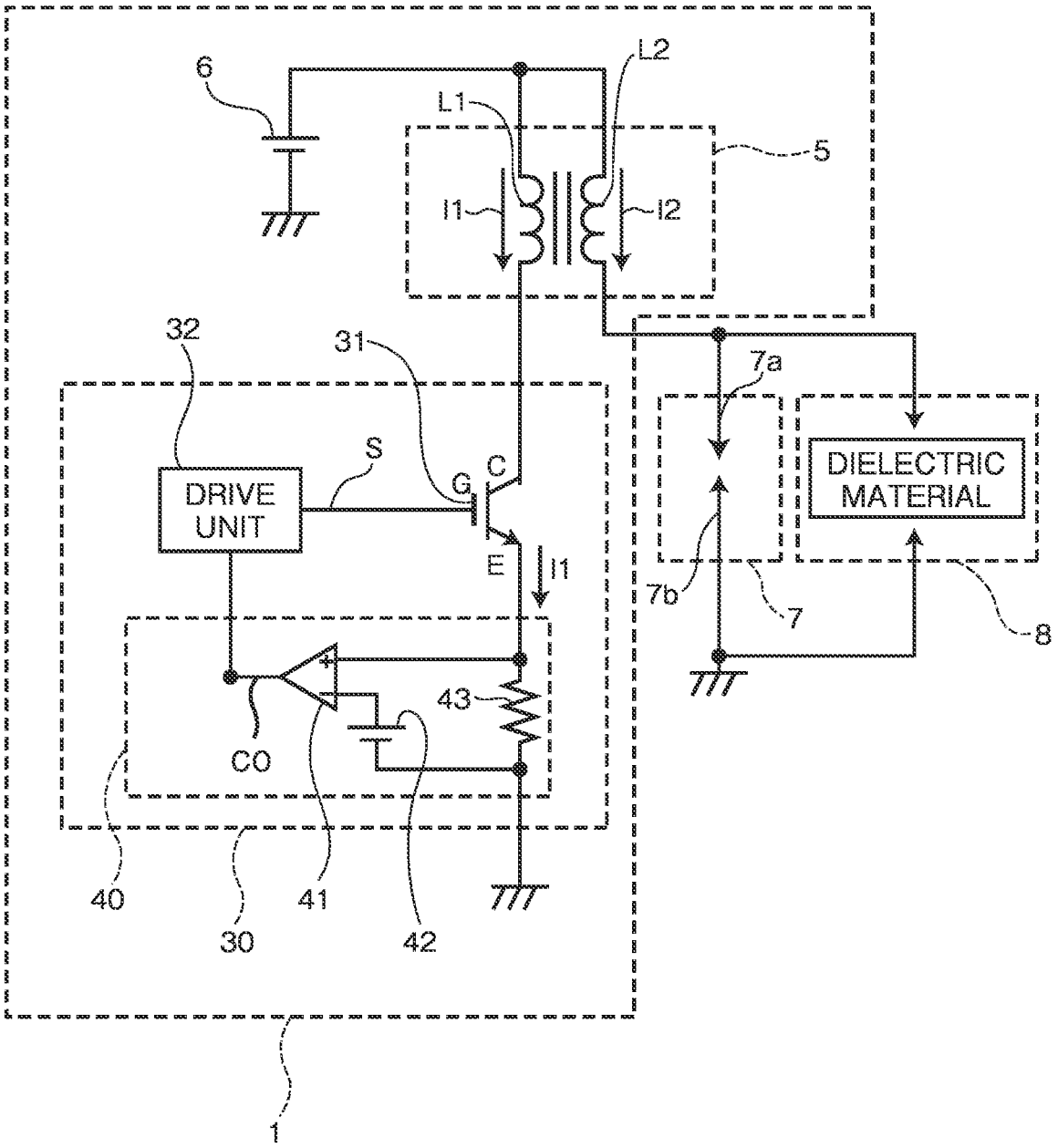
FIG. 2 is a block diagram illustrating components of an ignition system 11 including a control device 1 of FIG. 1.

FIG. 2 is a block diagram illustrating components of the ignition system 11 including the control device 1 of FIG. 1. The ignition system 11 of FIG. 2 is configured to include an ignition plug 7, a dielectric barrier discharge reactor 8 arranged in the reformer 13 to generate a dielectric barrier discharge to weaken molecular bonds, and a control device 1 as control means for controlling the ignition operation of the ignition plug 7 and the dielectric barrier discharge. Here, the discharge electrode 7*a* of the ignition plug 7 and the dielectric barrier discharge reactor 8 are electrically connected to each other.

The control device 1 of FIG. 2 is configured to include an ignition coil drive circuit 30, an ignition coil 5, and a battery 6 which is a power supply unit having a negative electrode, one of whose terminals is grounded. The ignition coil 5 is configured to include a primary coil L1, a secondary coil L2, and an iron core. One end of the primary coil L1 is connected to one end of the secondary coil L2 and a positive (+) side terminal of a positive electrode of the battery 6, and the other end of the primary coil L1 is connected to a collector terminal of an insulating gate bipolar transistor (hereinafter, simply referred to as "IGBT") 31 described below via a primary current input terminal. The other end of the secondary coil L2 is electrically connected to the ignition plug 7 and the dielectric barrier discharge reactor 8.

The ignition coil drive circuit 30 is configured to include a current detection unit 40 that detects a voltage corresponding to a primary current I1 flowing through the primary coil L1, an IGBT 31 as a switching element, and a drive unit 32 that controls the switching operation of the IGBT 31. In addition, the current detection unit 40 is configured to include a power supply 42 having a reference voltage Vref, a comparator 41, and a resistor 43 for detecting the electric current flowing through the IGBT 31. Here, one end of the resistor 43 is connected to an emitter terminal E of the IGBT 31, and the other end of the resistor 43 is grounded.

The comparator 41 inputs a value of a voltage difference (detected voltage corresponding to the primary current I1 flowing through the primary coil L1) across the resistor 43 corresponding to the electric current I1 flowing through the IGBT 31 to a non-inverting input terminal, and inputs a value of the reference voltage Vref to an inverting input terminal. Here, the comparator 41 compares a voltage difference across the resistor 43 and the value of the reference voltage Vref to generate a comparison result signal CO and output it to the drive unit 32. That is, when the voltage difference across the resistor 43 is larger than the reference voltage Vref, the comparator 41 outputs a high-level signal (H) as the comparison result signal CO. When the voltage difference across the resistor 43 is equal to or smaller than the reference voltage Vref, the comparator 41 outputs a low-level signal (L) as the comparison result signal CO.

The drive unit 32 includes a CPU that performs control processing or arithmetic processing relating to combustion control, various types of memories for storing and holding data, programs, or the like required for combustion control, and the like. The drive unit 32 generates a pulse signal having a predetermined pulse width in accordance with the combustion parameter as an ignition signal S based on the processing results of the CPU, and controls the powering on or shut down of the IGBT 31 based on the ignition signal S. In addition, the drive unit 32 controls a voltage of the control terminal of the IGBT 31 based on the comparison result signal CO such that the primary current I1 does not exceed a predetermined threshold value. That is, the current detection unit 40 functions as an over-current protection circuit. Here, the various types of memories include non-volatile recording mediums such as hard disks (HDD), flash memory, solid state drives (SSD), and the like.

The operation of the combustion system 2 configured as the above will be described below. Here, the combustion process of the combustion system 2 is executed under the control of the control device 1.

When the combustion process of the combustion system 2 of FIG. 1 is started, the valves 21*a* to 21*d* are closed first (step S100). Then, a dielectric barrier discharge is generated in the dielectric barrier discharge reactor 8 to separate and produce the hydrogen gas from the ammonia gas (step S101). Then, the valve 21*b* is controlled to open and the highly combustible hydrogen gas is fed to each pilot burner 14 to ignite the hydrogen gas (step S102). First, control is performed such that the hydrogen gas ejected from each pilot burner 14 is ignited by the ignition plug 7 to form a pilot flame. As a result, a cold space in the combustion chamber 4 is warmed by this pilot flame, so that it is possible to increase the temperature to a degree at which the highly flame-retardant ammonia gas is easily combusted.

Then, when the control device 1 determines that the temperature in the combustion chamber 4 has increased to a predetermined temperature, the control device 1 controls the valve 21*a* to be gradually opened (step S103). As a result, the highly flame-retardant ammonia gas is fed into the combustion chamber 4 as the swirling airflow S1 via the swirler 23. Here, the pilot flame of each pilot burner 14 is transferred to the ammonia gas to form a premixed flame, and the flame is ejected from the outlet port 24. That is, the ammonia gas supplied from the combusting hydrogen gas into the combustion chamber 4 is ignited (step S104).

Then, when the ammonia gas is combusted, the control device 1 detects an ion current value and controls the valve 21*b* to be closed based on the detected ion current value (step S105). That is, when the control device 1 determines that the highly flame-retardant ammonia gas has reached the optimal combustion state based on the ion current value, it stops the supply of the hydrogen gas into the combustion chamber 4. Here, it is possible to continue to stably combust the ammonia gas.

In addition, respective changes in flow rate of the hydrogen gas ejected from the pilot burners 14 in FIG. 1 and the ammonia gas ejected from the swirler 23 in FIG. 1 will be described below.

Figure 3:
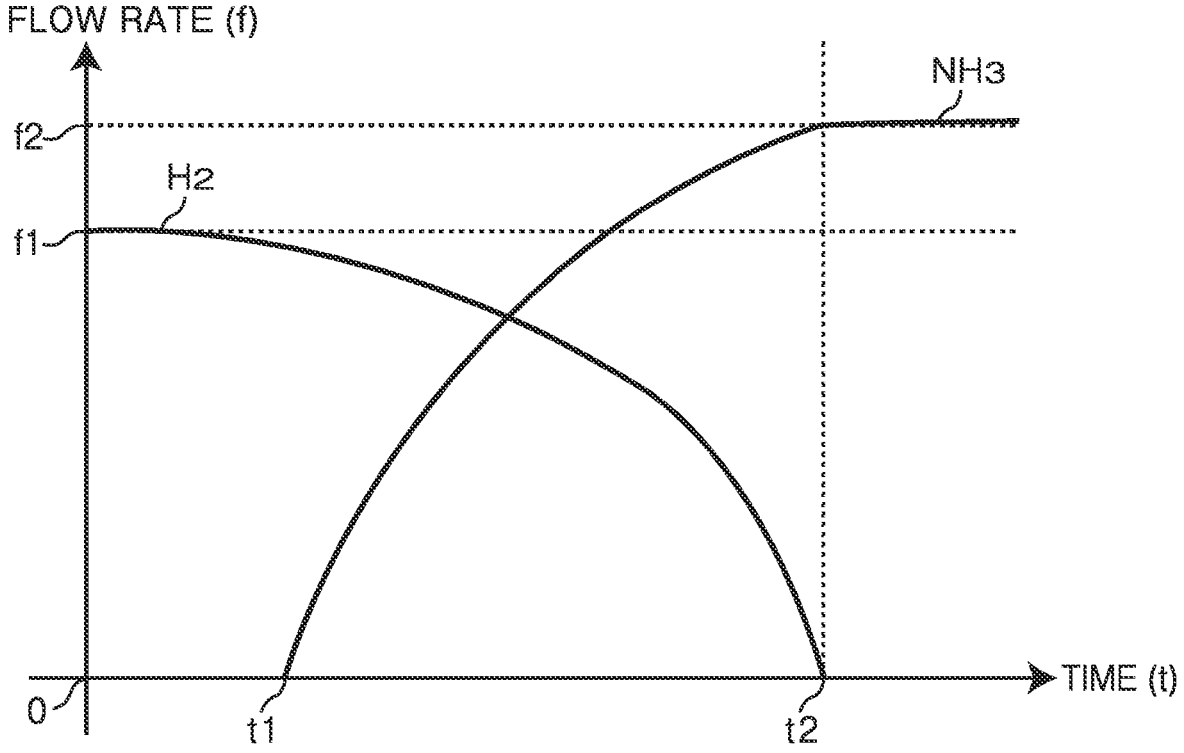
FIG. 3 is a time base waveform graph illustrating the respective changes in flow rate over time t of the hydrogen gas ejected from pilot burners 14 of FIG. 1 and the ammonia gas ejected from a swirler 23 of FIG. 1.

FIG. 3 is a time base waveform graph illustrating the respective changes in flow rate over time t of the hydrogen gas ejected from the pilot burners 14 of FIG. 1 and the ammonia gas ejected from the swirler 23 of FIG. 1. In FIG. 3, the control is performed such that, at the start of the combustion process (time t=0), the hydrogen gas starts being ejected from each pilot burner 14 at a flow rate f1, and at the same time, the hydrogen gas is ignited and combusted. Here, the hydrogen gas ejected from each pilot burner 14 is ignited by the ignition plug 7 to form a pilot flame. Note that the flow rate f of the hydrogen gas is controlled to gradually decrease so as to become zero when the ammonia gas reaches a stable combustion state.

When the hydrogen gas starts to combust and the temperature in the combustion chamber 4 increases to a predetermined temperature (time t=t1), the ammonia gas is ejected into the combustion chamber 4 such that the flow rate f of the ammonia gas from the swirler 23 gradually increases. Here, the pilot flame of each pilot burner 14 is transferred to the ammonia gas to form a premixed flame, and the flame is ejected from the outlet port 24. When it is determined that the combustion state of the ammonia gas is stable (time t=t2), control is performed such that the flow rate f of the hydrogen gas becomes zero, and at the same time, the flow rate f of the ammonia gas becomes, a flow rate f2, which is larger than the initial flow rate f1 of the hydrogen gas.

In this configuration, first the highly combustible hydrogen gas is combusted to form a stable flame in the circumferential direction, then the efficiency of transferring the flame to the highly flame-retardant ammonia gas is improved to enable a more stable combustion of the ammonia gas. Consequently, since it is possible to stabilize the combustion of the ammonia gas, it is possible to more stably combust the ammonia gas by forming a flame by the highly flame-retardant ammonia gas. Here, the effect of "stably combusting the ammonia by forming a flame by the ammonia" includes an effect of reducing fluctuation in combustion, which is a state in which the fuel changes the combustion state, and further includes an effect of reducing a vibration from combustion, which is a phenomenon that causes an entire device to vibrate due to the pulsation of combustion gas pressure caused by intermittent combustion.

In the combustion method according to the above embodiment, first the hydrogen gas is combusted to warm the combustion chamber to a certain degree, then the flame-retardant ammonia gas is supplied so that the flame is transferred from the combusted hydrogen gas to the supplied ammonia gas. Therefore, it is possible to effectively initially ignite the ammonia gas and continue to stably combust the ammonia gas even after ignition.

Embodiment 2

The embodiment described above has been configured so as to enable the highly flame-retardant ammonia gas to be effectively guided to the optimal combustion state by first combusting the hydrogen gas to warm the inside of the combustion chamber 4 to a certain degree, then supplying the flame-retardant ammonia gas so that the flame is transferred from the combusted hydrogen gas to the supplied ammonia gas. In comparison, the present embodiment is characterized in that the flame transfer destination from the combusted hydrogen gas is a mixed gas (gas mixture) of the ammonia gas and the hydrogen gas. In this configuration, it is possible to more effectively guide the highly flame-retardant ammonia gas to the optimal combustion state.

Figure 4:
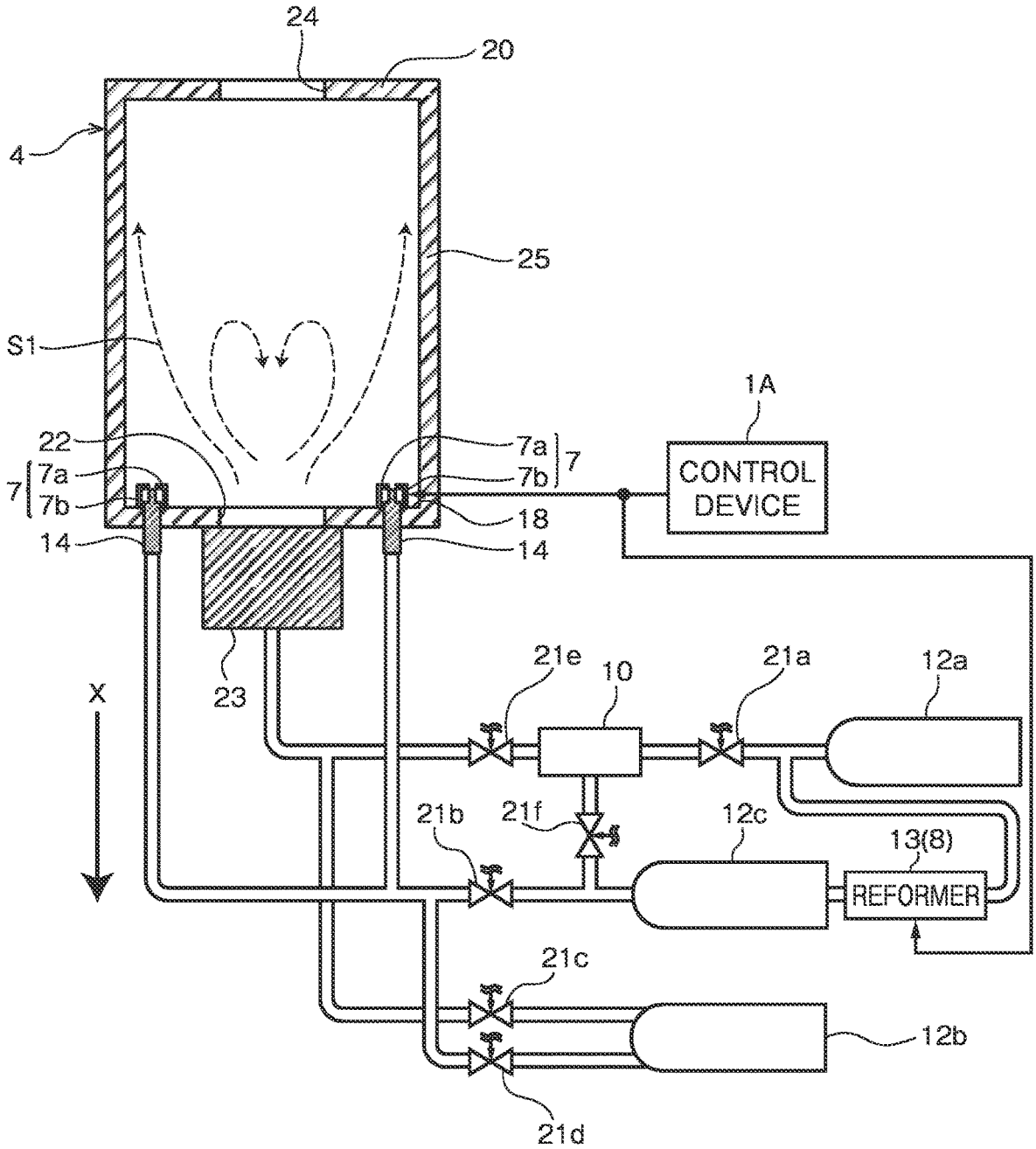
FIG. 4 is a partially cutaway side view illustrating a combustion system 2A according to Embodiment 2 of the present invention and a block diagram illustrating its peripheral components.

FIG. 4 is a partially cutaway side view illustrating a combustion system 2A according to Embodiment 2 of the present invention and a block diagram illustrating its peripheral components. In comparison to the combustion system 2 of FIG. 1, the combustion system 2A of FIG. 4 includes a control device 1A in place of the control device 1, and is characterized by further including a mixer 10 that mixes the hydrogen gas and the ammonia gas separated and produced by the reformer 13, a valve 21*e* that adjusts an amount of the mixed gas supplied from the mixer 10 to the combustion chamber, and a valve 21*f* that adjusts an amount of the hydrogen gas supplied from the fuel tank 12*c* to the mixer 10. In addition, the control device 1A of FIG. 4 is different from the control device 1 of FIG. 1 in that the amounts at which the ammonia gas and the hydrogen gas are mixed in the mixer 10 are adjusted by further controlling the opening and closing of the valves 21*e* and 21*f*.

The operation of the combustion system 2A according to Embodiment 2 configured as the above will be described below. Here, the combustion process of the combustion system 2A is executed under the control of the control device 1A.

When the combustion process of the combustion system 2A of FIG. 4 is started, first the valves 21*a* to 21*f* are controlled to be closed (step S200). Then, a dielectric barrier discharge is generated in the dielectric barrier discharge reactor 8 to separate and produce the hydrogen gas from the ammonia gas (step S201). Then, when the valve 21*b* is controlled to be opened, the highly combustible hydrogen gas is fed to each pilot burner 14, and this hydrogen gas is ignited (step S202). First, control is performed such that the hydrogen gas ejected from each pilot burner 14 is ignited by the ignition plug 7 to form a pilot flame. As a result, a cold space in the combustion chamber 4 is warmed by this pilot flame so that it is possible to increase the temperature to a degree at which the highly flame-retardant ammonia gas is easily combusted.

Then, when the control device 1 determines that the temperature in the combustion chamber 4 has increased to a predetermined temperature, the control device 1 controls each of the valves 21*a* and 21*f* to be gradually opened (step S203). As a result, the amounts at which the hydrogen gas and the ammonia gas are mixed in the mixer 10 are adjusted as per the mixing amounts shown in FIG. 6 described below. Also, the control device 1A controls the valve 21*e* to be gradually opened (step S204). As a result, the highly flame-retardant mixed gas is fed into the combustion chamber 4 as the swirling airflow S1 via the swirler 23. Here, the pilot flame of each pilot burner 14 is transferred to the mixed gas to form a premixed flame, and the flame is ejected from the outlet port 24. That is, the mixed gas supplied from the combusting hydrogen gas into the combustion chamber 4 is ignited (step S205).

Then, when the mixed gas is combusted, the control device 1A detects an ion current value and controls the valve 21*b* to be closed based on the detected ion current value (step S206). That is, when the control device 1A determines that the highly flame-retardant mixed gas has reached the optimal combustion state based on the ion current value, the control device 1A performs control to stop the supply of the hydrogen gas into the combustion chamber 4 and close the valve 21*f* to adjust the amount of the hydrogen gas mixed in the mixer 10 to zero. At this time, since the amount of the hydrogen gas mixed in the mixed gas is zero, the combusting fuel is only the ammonia gas. That is, it is possible to continue to stably combust the ammonia gas.

In addition, the respective changes in flow rate of the hydrogen gas ejected from the pilot burners 14 of FIG. 4 and the ammonia gas ejected from the swirler 23 of FIG. 4 will be described below.

Figure 5:
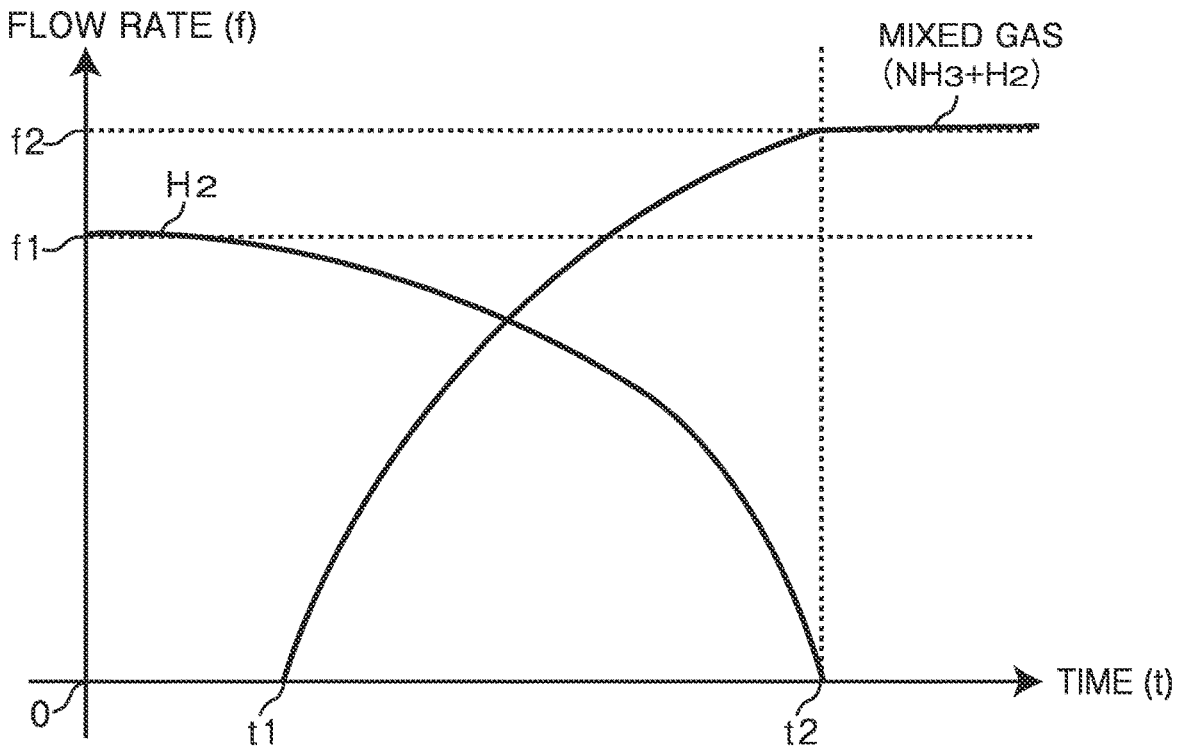
FIG. 5 is a time base waveform graph illustrating the respective changes in flow rate over time t of the hydrogen gas ejected from the pilot burners 14 of FIG. 4 and the mixed gas ejected from the swirler 23 of FIG. 4.

FIG. 5 is a time base waveform graph illustrating the respective changes in flow rate over time t of the hydrogen gas ejected from the pilot burners 14 of FIG. 4 and the mixed gas ejected from the swirler 23 of FIG. 4. In FIG. 5, control is performed such that, at the start of the combustion process (time t=0), the hydrogen gas starts being ejected from each pilot burner 14 at a flow rate f1, and at the same time, the hydrogen gas is ignited and combusted. Here, the hydrogen gas ejected from each pilot burner 14 is ignited by the ignition plug 7 to form a pilot flame. Note that the flow rate f of the hydrogen gas is controlled to gradually decrease to zero when the mixed gas reaches a stable combustion state.

When the hydrogen gas starts to combust and the temperature in the combustion chamber 4 increases to a predetermined temperature (time t=t1), the mixed gas is ejected into the combustion chamber 4 such that the flow rate f of the mixed gas from the swirler 23 gradually increases. Here, the pilot flame of each pilot burner 14 is transferred to the mixed gas to form a premixed flame, and the flame is ejected from the outlet port 24. When it is determined that the combustion state of the mixed gas is stable (time t=t2), control is performed such that the flow rate f of the hydrogen gas becomes zero, and at the same time, the flow rate f of the mixed gas becomes a flow rate f2, which is larger than the initial flow rate f1 of the hydrogen gas.

Figure 6:
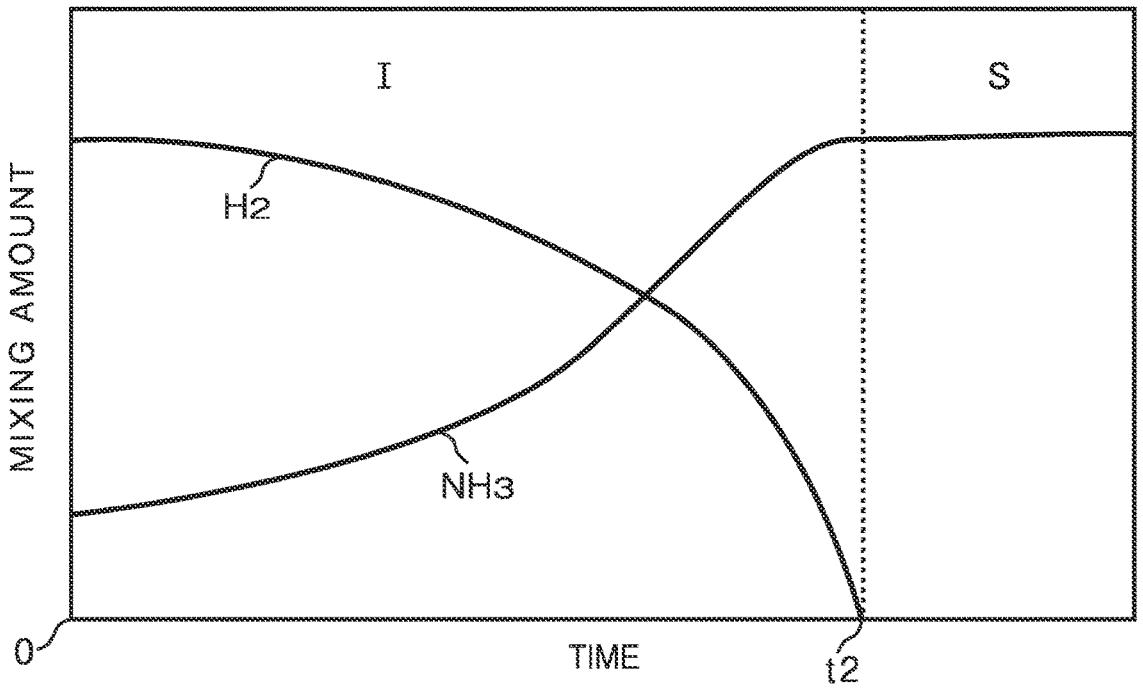
FIG. 6 is a time base waveform graph illustrating the changes in amounts, over time, at which the hydrogen gas and the ammonia gas are mixed in a mixer 10 of FIG. 4 by using the elapsed time base common to FIG. 5.

FIG. 6 is a time base waveform graph illustrating the changes in amounts, over time, at which the hydrogen gas and the ammonia gas are mixed in the mixer 10 of FIG. 4 by using the elapsed time base common to FIG. 5. In FIG. 6, the amounts at which the hydrogen gas and the ammonia gas are mixed in the mixer 10 are set such that the amount at which the hydrogen gas is mixed is larger than that of the ammonia gas at the start of the combustion process (time t=0). In the initial combustion step I, the amount at which the ammonia gas is mixed increases, and the amount at which the hydrogen gas is mixed decreases over time. When the combustion state of the mixed gas is determined to be stable (time t2), the process advances to the next steady combustion step S. Here, the amount of the hydrogen gas mixed in the mixed gas becomes zero, and only the ammonia gas is ejected from the swirler 23.

In the combustion method according to the embodiment above, first the hydrogen gas is combusted to warm the combustion chamber to a certain degree, then the mixed gas of the ammonia gas and the hydrogen gas is supplied so that the flame is transferred from the combusted hydrogen gas to the supplied mixed gas. Therefore, in comparison to Embodiment 1, it is possible to more effectively initially ignite the ammonia gas and continue to stably combust the ammonia gas even after ignition.

The embodiment described above has been described using ammonia as the flame-retardant fuel; however, the present invention is not limited hereto. For example, an ammonia compound or another flame-retardant fuel may also be used as the flame-retardant fuel, and further, another substance, such as a carbon-based compound, may also be mixed using them as a main material. That is, according to the present invention, the combustion system includes a combustion chamber in which the injected fuel is internally combusted, a swirler provided in the combustion chamber that feeds a first fuel into the combustion chamber as a swirling airflow, a reformer that reforms the first fuel through a dielectric barrier discharge to produce a second fuel that is more combustible than the first fuel, a pilot burner that ejects the second fuel that is more combustible than the first fuel into the combustion chamber, an ignition plug that ignites the pilot burner, and a control device that controls the ignition operation of the ignition plug. The control device can also be applied to a combustion system that controls the dielectric barrier discharge in the reformer.

In addition, in the embodiment described above, the drive unit 32 has been configured to control the powering on or shut down of the IGBT 31 using data, programs, or the like held in various types of memories and necessary for a CPU that performs control processing or arithmetic processing relating to the combustion control or necessary for the combustion control, however, the present invention is not limited hereto. For example, the drive unit 32 may be configured to control the powering on or shut down of the IGBT 31 based on at least one of a voltage of the battery 6 and a voltage between the primary coil L1 and the IGBT 31, which is a switching element. Even in this case, it is possible to obtain the same action and effect as that of the present embodiment. In addition, in comparison to the present embodiment, since the voltage across the secondary coil L2 is a value obtained by multiplying the voltage across the primary coil L1 by a winding number ratio, it is possible to easily identify the value of the voltage across the secondary coil L2.

In addition, in the embodiment described above, energy is directly supplied from the secondary coil L2 to the reformer 13 and the ignition plug 7, however the present invention is not limited hereto. For example, a Zener diode or a resistor may be connected between the secondary coil L2 and the discharge electrode 7*a* of the ignition plug 7. Alternatively, a Zener diode or a resistor may be connected between the secondary coil L2 and the dielectric barrier discharge reactor 8. Even in this case, it is possible to obtain the same action and effect as that of the present embodiment. In addition, in comparison to the present embodiment, it is possible to adjust the energy supplied from the secondary coil L2 to the reformer 13 and the ignition plug 7.

Furthermore, in the embodiment described above, the control device 1 has been configured to stop the supply of the hydrogen gas when it has determined that the ammonia gas has reached the optimal combustion state based on the combustion state, however the present invention is not limited hereto. For example, the control device 1 may be configured to adjust the amount of the hydrogen gas supplied based on the combustion state of the ammonia gas. In this case, in comparison to the embodiment described above, it is possible to promptly adjust the amount of the hydrogen gas supplied according to the combustion state of the ammonia gas. Therefore, it is possible to continue to stably combust the ammonia gas more effectively.

The embodiments of the present invention have been described; however, the aforementioned embodiments are suggested by way of example and are not intended to limit the scope of the invention. These novel embodiments can be implemented in various other modes, for which various omissions, substitutions, or changes may be possible without departing from the spirit of the invention. The embodiments and modifications thereof are included in the scope and spirit of the invention, and are also included in the scope of the invention described in the claims and equivalents thereof.

REFERENCE SIGNS LIST

1, 1A control device
2, 2A combustion system
4 combustion chamber
5 ignition coil
6 battery
7 ignition plug
8 dielectric barrier discharge reactor
10 mixer
11 ignition system
13 reformer
14 pilot burner
18 bottom portion
20 lid portion
21*a* to 21*f* valves
22 inlet port
23 swirler
24 outlet port

The invention claimed is:

1. An ammonia combustion method for combusting ammonia gas in a combustion chamber, comprising:
separating and producing hydrogen gas from ammonia gas;
supplying the separated and produced hydrogen gas into the combustion chamber;
combusting the hydrogen gas by performing an ignition discharge on the hydrogen gas supplied into the combustion chamber;
supplying the ammonia gas into the combustion chamber when a temperature in the combustion chamber reaches a predetermined temperature; and
igniting the ammonia gas in the combustion chamber from the combusted hydrogen gas.

2. An ammonia combustion method for combusting ammonia gas in a combustion chamber, comprising:
separating and producing hydrogen gas from ammonia gas;
supplying the separated and produced hydrogen gas into the combustion chamber;
combusting the hydrogen gas by performing an ignition discharge on the hydrogen gas supplied into the combustion chamber;
igniting the ammonia gas in the combustion chamber from the combusted hydrogen gas;
detecting combustion state information indicating a combustion state of the ammonia gas; and
adjusting an amount of the hydrogen gas supplied into the combustion chamber based on the detected combustion state information.

3. The ammonia combustion method according to claim 2, wherein the combustion state information is information regarding an ion current based on ions generated by combusting the ammonia gas, or a turbine output using energy caused by combusting the ammonia gas.

4. An ammonia combustion method for combusting ammonia gas in a combustion chamber, comprising:
separating and producing hydrogen gas from ammonia gas;
supplying the separated and produced hydrogen gas into the combustion chamber:
combusting the hydrogen gas by performing an ignition discharge on the hydrogen gas supplied into the combustion chamber; and
igniting the ammonia gas in the combustion chamber from the combusted hydrogen gas,
wherein, when separating and producing the hydrogen gas from the ammonia gas, the hydrogen gas is separated and produced by reforming the ammonia gas through a dielectric barrier discharge.

5. An ammonia combustion method for combusting ammonia gas in a combustion chamber, comprising:
separating and producing hydrogen gas from ammonia gas;
supplying the separated and produced hydrogen gas into the combustion chamber;
combusting the hydrogen gas by performing an ignition discharge on the hydrogen gas supplied into the combustion chamber;
supplying a mixed gas obtained by mixing the separated and produced hydrogen gas and the ammonia gas into the combustion chamber; and
igniting the supplied mixed gas from the combusted hydrogen gas.

6. The ammonia combustion method according to claim 5, further comprising reducing a proportion of the hydrogen gas in the mixed gas after igniting the mixed gas.

7. An ammonia combustion system for combusting injected ammonia gas in a combustion chamber, comprising:
a first pipe configured to supply the ammonia gas into the combustion chamber;
a first valve individually provided in the first pipe;

a reformer configured to separate and produce hydrogen gas from the ammonia gas;

a second pipe configured to supply the separated and produced hydrogen gas into the combustion chamber;

a second valve individually provided in the second pipe;

an ignition plug configured to perform an ignition discharge on the hydrogen gas supplied into the combustion chamber to combust the hydrogen gas; and circuitry configured to:

open and close the first and second valves and the ignition discharge of the ignition plug, and perform control such that the second valve is opened, the hydrogen gas is combusted by starting the ignition discharge, and then the first valve is opened after the combustion of the hydrogen gas.

8. An ammonia combustion system for combusting injected ammonia gas in a combustion chamber, comprising:

a first pipe configured to supply the ammonia gas into the combustion chamber;

a first valve individually provided in the first pipe;

a reformer configured to separate and produce hydrogen gas from the ammonia gas;

a second pipe configured to supply the separated and produced hydrogen gas into the combustion chamber;

a second valve individually provided in the second pipe;

an ignition plug that performs an ignition discharge on the hydrogen gas supplied into the combustion chamber to combust the hydrogen gas; and circuitry configured to:

open and close the first and second valves and the ignition discharge of the ignition plug, and increase the temperature in the combustion chamber to a predetermined temperature on the basis of the temperature in the combustion chamber detected by the temperature sensor.

9. An ammonia combustion system for combusting injected ammonia gas in a combustion chamber, comprising:

a first pipe configured to supply the ammonia gas into the combustion chamber;

a first valve individually provided in the first pipe;

a reformer configured to separate and produce hydrogen gas from the ammonia gas;

a second pipe configured to supply the separated and produced hydrogen gas into the combustion chamber;

a second valve individually provided in the second pipe;

an ignition plug configured to perform an ignition discharge on the hydrogen gas supplied into the combustion chamber to combust the hydrogen gas; and circuitry configured to:

open and close the first and second valves and the ignition discharge of the ignition plug, detect combustion state information indicating a combustion state of the ammonia gas in the combustion chamber, and perform control so as to adjust an amount of the hydrogen gas supplied into the combustion chamber on the basis of the detected combustion state information.

10. The ammonia combustion system according to claim 9, wherein the combustion state information is information regarding an ion current based on ions generated by combusting the ammonia gas, or a turbine output using energy caused by combusting the ammonia gas.

11. An ammonia combustion system for combusting injected ammonia gas in a combustion chamber, comprising:

a first pipe configured to supply the ammonia gas into the combustion chamber;

a first valve individually provided in the first pipe;

a reformer configured to separate and produce hydrogen gas from the ammonia gas;

a second pipe configured to supply the separated and produced hydrogen gas into the combustion chamber:

a second valve individually provided in the second pipe;

an ignition plug configured to perform an ignition discharge on the hydrogen gas supplied into the combustion chamber to combust the hydrogen gas; and circuitry configured to:

open and close the first and second valves and the ignition discharge of the ignition plug, and reform the ammonia gas to separate and produce the hydrogen gas by controlling a dielectric barrier discharge in the reformer.

* * * * *